United States Patent [19]

Ryden

[11] Patent Number: 4,543,681

[45] Date of Patent: Oct. 1, 1985

[54] REMOTELY OPERATED CHIMNEY CLEANING APPARATUS

[76] Inventor: David M. Ryden, Box 391, Hallock, Minn. 56728

[21] Appl. No.: 588,089

[22] Filed: Mar. 9, 1984

[51] Int. Cl.[4] ..... F23J 3/00

[52] U.S. Cl. ..... 15/163; 15/243

[58] Field of Search ..... 15/162, 163, 242, 243, 15/249

[56] References Cited

U.S. PATENT DOCUMENTS

| | | | |
|---|---|---|---|
| 150,164 | 4/1874 | Kacserowsky . | |
| 181,672 | 8/1876 | Grimes . | |
| 598,672 | 2/1898 | Dunn | 15/249 |
| 1,054,924 | 3/1913 | Latzsch et al. . | |
| 1,104,030 | 7/1914 | Willat | 15/163 X |
| 1,320,887 | 11/1919 | Michels, Sr. | 15/249 |
| 2,536,185 | 1/1951 | Johnson . | |
| 4,310,942 | 1/1982 | Krape . | |
| 4,319,378 | 3/1982 | Bowman et al. . | |

FOREIGN PATENT DOCUMENTS

| | | | |
|---|---|---|---|
| 184734 | 5/1907 | Fed. Rep. of Germany | 15/249 |
| 488541 | 1/1930 | Fed. Rep. of Germany | 15/249 |

OTHER PUBLICATIONS

Marley Advertisements; Farm Journal, Jan. 84, p. 14.

*Primary Examiner*—Peter Feldman

*Attorney, Agent, or Firm*—Merchant, Gould, Smith, Edell, Welter & Schmidt

[57] ABSTRACT

A chimney sweeping device is disclosed. The device includes a frame which is mounted on the flue at the top of the chimney. The top section of the frame is enclosed on its three sides and top and has a pair of trap doors hingably mounted on its bottom side. The bottom section of the frame consists of four angle iron legs, at least two of which are hingably mounted to the flue so that the frame may be tipped or tilted away from the top of the flue. A chimney sweeping brush and a weight for pushing the brush down the chimney are provided and are suspended inside the frame via a central pulley mounted at the apex of the top section. Apparatus responsive to the position of the block and brush is provided to open and close the trap doors so that when the block and brush are raised to their highest-most storage position inside the top section of the frame, the trap doors are pulled up closed to seal the top section, and so that when the block and brush are lowered the trap doors drop open to permit their passage therethrough and on down into the chimney flue for cleaning. The cable suspending the block and brush travels through a pulley system across the roof and down the side of the house to a winch system whereby a chimney sweeping operation may be accomplished from the ground.

7 Claims, 5 Drawing Figures

FIG. 1
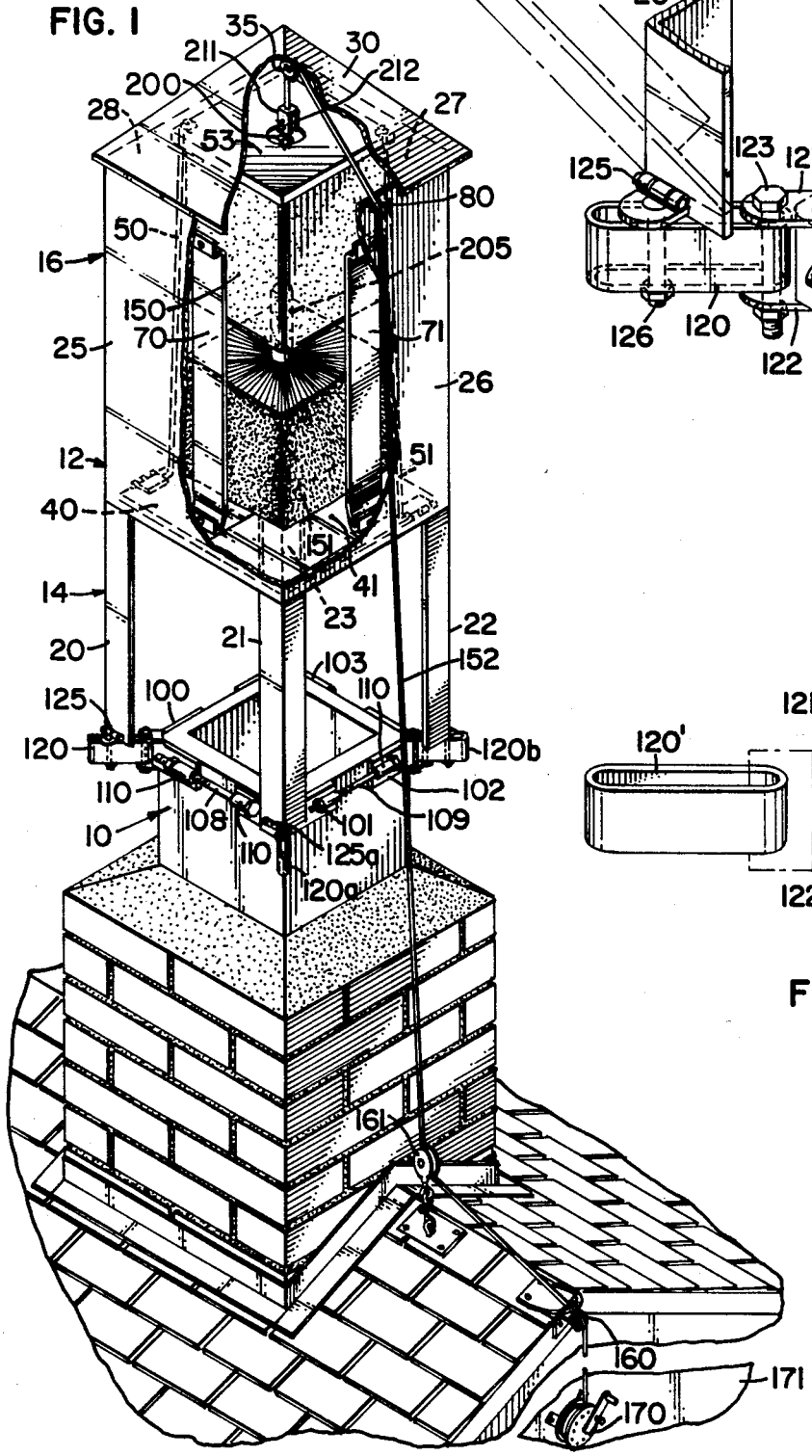
FIG. 2
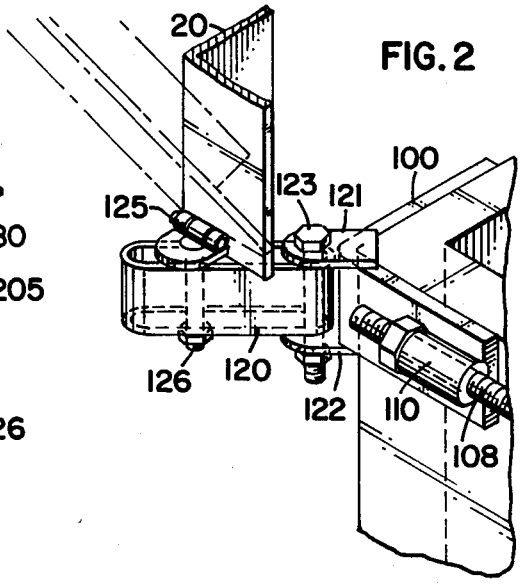
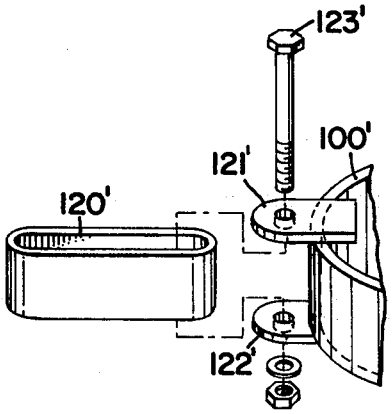
FIG. 3

REMOTELY OPERATED CHIMNEY CLEANING APPARATUS

TECHNICAL FIELD OF THE INVENTION

The present invention relates generally to the field of chimney cleaning apparatus and more particularly to remotely operated, chimney-top mounted, chimney cleaning apparatus.

BACKGROUND OF THE INVENTION

It is well known that a chimney needs to be cleaned regularly in order to avoid the danger of chimney fire and to maintain the efficiency of stoves and fireplaces. It is also well known that roof top chimney cleaning methods can be dangerous undertakings, especially for the amateur or homeowner lacking the skills and safety tools of the trade, and that damage to the roof may also result from roof top operations.

Accordingly, many chimney cleaning devices have been devised to alleviate the hazards and problems associated with roof top cleaning. Some are designed to permit cleaning from the bottom of the chimney where fireplace design permits, for example, those devices disclosed in U.S. Pat. No. 4,310,942 to Krape, U.S. Pat. No. 1,054,924 to Latzsch and U.S. Pat. No. 181,672 to Grimes. Certainly, these devices eliminate the safety hazard presented by rooftop cleaning but they are generally more complicated and have more potential for malfunction or jamming inside the flue than more conventional chimney-top operated cleaning devices. And, cleaning a chimney from the bottom can be extremely unpleasant and messy.

Other patents disclose apparatus for cleaning the chimney from its top, for example U.S. Pat. No. 4,319,378 to Bowman et al, or various sorts of brushes which may also be used to clean a chimney from the top, as for example seen in U.S. Pat. No. 2,536,185 to Johnson or U.S. Pat. No. 150,164 to Kacserowsky. Using these devices, as noted above, can be dangerous for amateurs or homeowners when employed from the top of a chimney.

Notwithstanding the many prior art devices, there remains a need for a safe, simple, easy to operate chimney cleaning device. The present invention may be employed to meet that need.

SUMMARY OF THE INVENTION

The present invention provides a safe chimney top mounted remotely operated cleaning device. The invention includes a frame mounted on top of a chimney to extend upwardly, with the frame including top and bottom sections. the bottom section includes one or more openings for venting chimney effluent while the top section includes pulley means mounted near the top thereof. Chimney sweeping means, preferably a brush and a weight, are suspended by a cable running over the pulley for movement up and down the chimney flue for cleaning thereof. The sweeping means may be positioned when not in use inside the top section of the frame.

According to one aspect of the invention the frame mount includes hinges for pivotably connecting the frame to the chimney so that it may be moved clear from above the chimney when need be.

According to another aspect of the invention the top section of the frame is covered on its top and sides to provide an enclosure for the sweeping means when positioned therein, and trap door means for covering the bottom thereof to provide a substantially sealed compartment for the sweeping means between cleaning operations.

According to another aspect of the invention the trap door means includes means responsive to the sweeping means to cause the doors to close when the sweeping means is positioned in the top section and to permit the doors to open when the sweeping means is lowered out of the top section. These and other features of the invention are described in the ensuing specification and claims.

BRIEF DESCRIPTION OF THE DRAWINGS

FIG. 1 is a perspective view of the present invention as mounted on a chimney top;

FIG. 2 is an enlarged fragmentary view of the mounting apparatus of the present invention;

FIG. 3 is an enlarged fragmentary view of an alternate mounting apparatus according to the present invention;

DETAILED DESCRIPTION OF THE INVENTION

Figure 4:
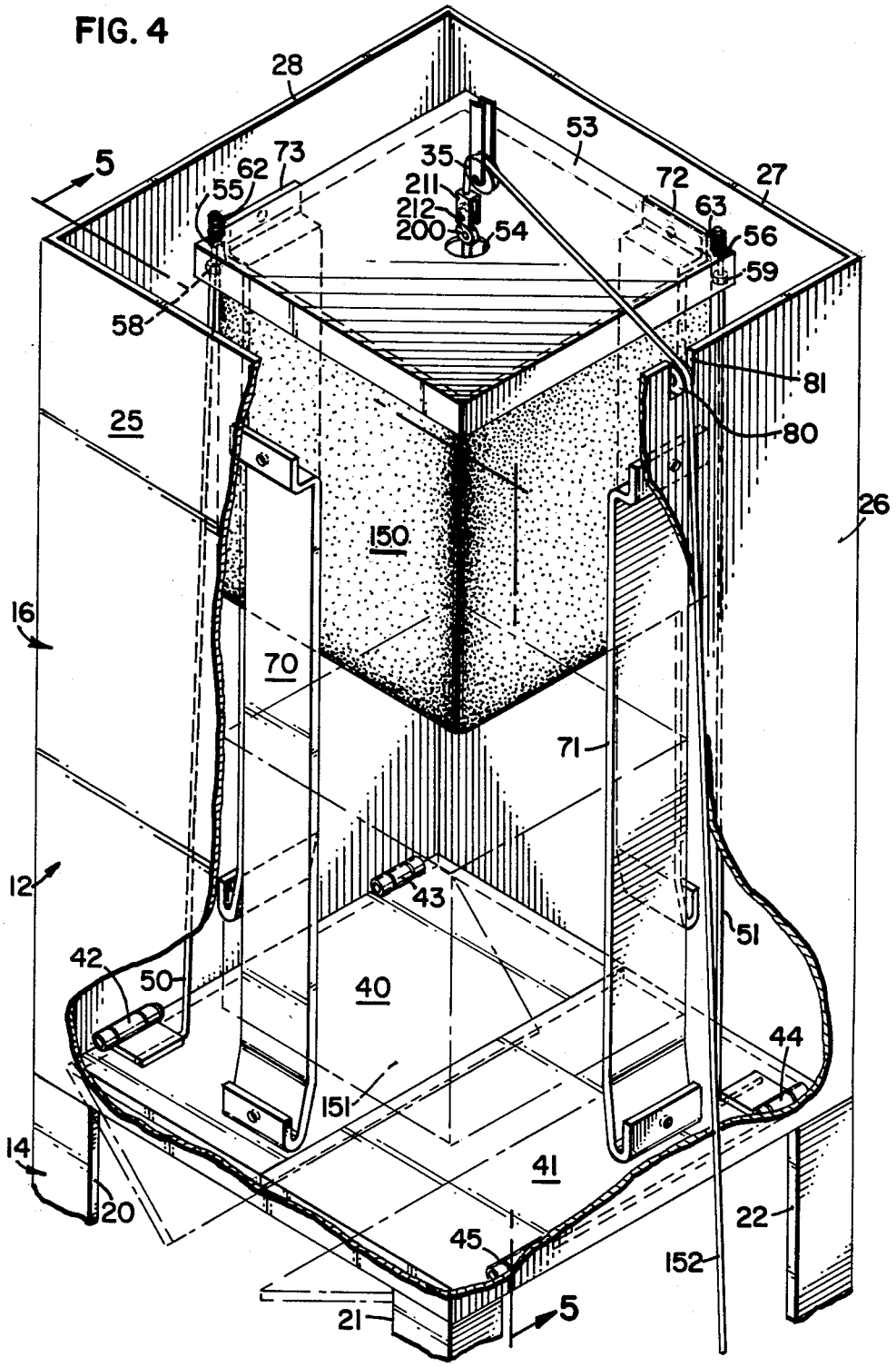
FIG. 4 is a cutaway perspective view of the top section of the chimney sweeping apparatus according to the present invention.

Referring to FIG. 1, the chimney sweeping apparatus of the present invention may be seen mounted for use atop a chimney flue 10. A frame 12 is provided and includes a bottom section 14 and a top section 16. Bottom section 14 includes four support members or legs 20, 21, 22 and 23 while top section 16 includes four side-walls 25, 26, 27 and 28. Top section 16 further includes a cap or cover 30 generally pyramidic in shape, and a pulley 35 mounted for free rotation from the apex thereof.

At the junction of top and bottom sections 14 and 16 a pair of trap doors 40 and 41 are provided, as may be seen better with reference to FIG. 4. Trap doors 40 and 41 are mounted to respective side-walls 28 and 26 via hinge pairs 42, 43, 44 and 45. Hinges 42 and 44 are linked via rods 50 and 51 respectively, to an inverted pan or cap member 53. Pan or cap 53 includes an opening 54 in its center for cable running therethrough as will be explained in more detail hereinafter, and openings 55 and 56, through which rods 50 and 51 respectively pass. Stop members 58 and 59 are provided on the respective rods 50 and 51. As may be seen more clearly with reference to FIG. 5, a pair of spring coils 60 and 61 are provided around rods 50 and 51 respectively, above pan 53, and below a pair of stop members 62 and 63 at the tip of respective rods 50 and 51. Preferably, stop members 58, 59, 62 and 63 are threaded nuts with rods 50 and 51 including threads thereon so that said stops may be adjusted and positioned thereon.

Top section 16 further includes four guide members 70–73 which are mounted at their opposite ends, via bolt and nut, welding or the like, to each of the respective side-walls 25–28. Top section 16 further includes a further pulley 80 mounted for free rotation within notch 81 of side-wall 26.

Referring again to FIG. 1, and FIGS. 2 and 3, the apparatus for mounting frame 12 on the chimney flue 10 may be seen. In the case of a rectangular flue, as shown in FIG. 1, the mounting apparatus includes four corner pieces 100–103, which are sinched around flue 10 by nut and bolt assemblies, for example assemblies 108 and 109, which pass through tubular members 110, which are welded or otherwise attached to the corner pieces. As may be seen better with reference to FIG. 2, each of the corner members (100–103) further include an ovular bracket member 120 mounted to each corner member via brackets 121 and 122 and nut and bolt assembly 123. Bracket members 120 permit the mounting apparatus to be adjusted to accommodate different sizes of flues, as is readily apparent to those skilled in the art. A hinge member 125 is mounted to member 120 via another nut and bolt assembly 126. Preferably, hinge members 125 are provided on at least one side of the mounting apparatus, as for example shown in FIG. 1, with respect to mounting members 120 and **120*a* and hinge members 125 and 125*a*, to permit the entire frame to be tipped or tilted downwardly and away from above flue 10. Accordingly, the mounting or attachment of the opposite side members, members 22 and 23 in the present illustration, may be accomplished without hinges if desired, for example by simple provision of a bolt welded to extend downwardly from the opposite side members for securement to the brackets 120 by a threaded nut assembly. However, in its preferred embodiment the present invention provides for the same mounting arrangement on either side of the frame 12**, so that the frame may be hinged down and away in either one of two opposite directions.

An alternate embodiment of the corner members (100–103) of the mounting apparatus is shown in FIG. 3, in which the "corner" members 100' are arcuate to accommodate a round, oval or cylindrical flue. Like components 120'–123' complete the alternate mounting assembly apparatus as discussed with reference to corresponding components 120–123.

Figure 5:
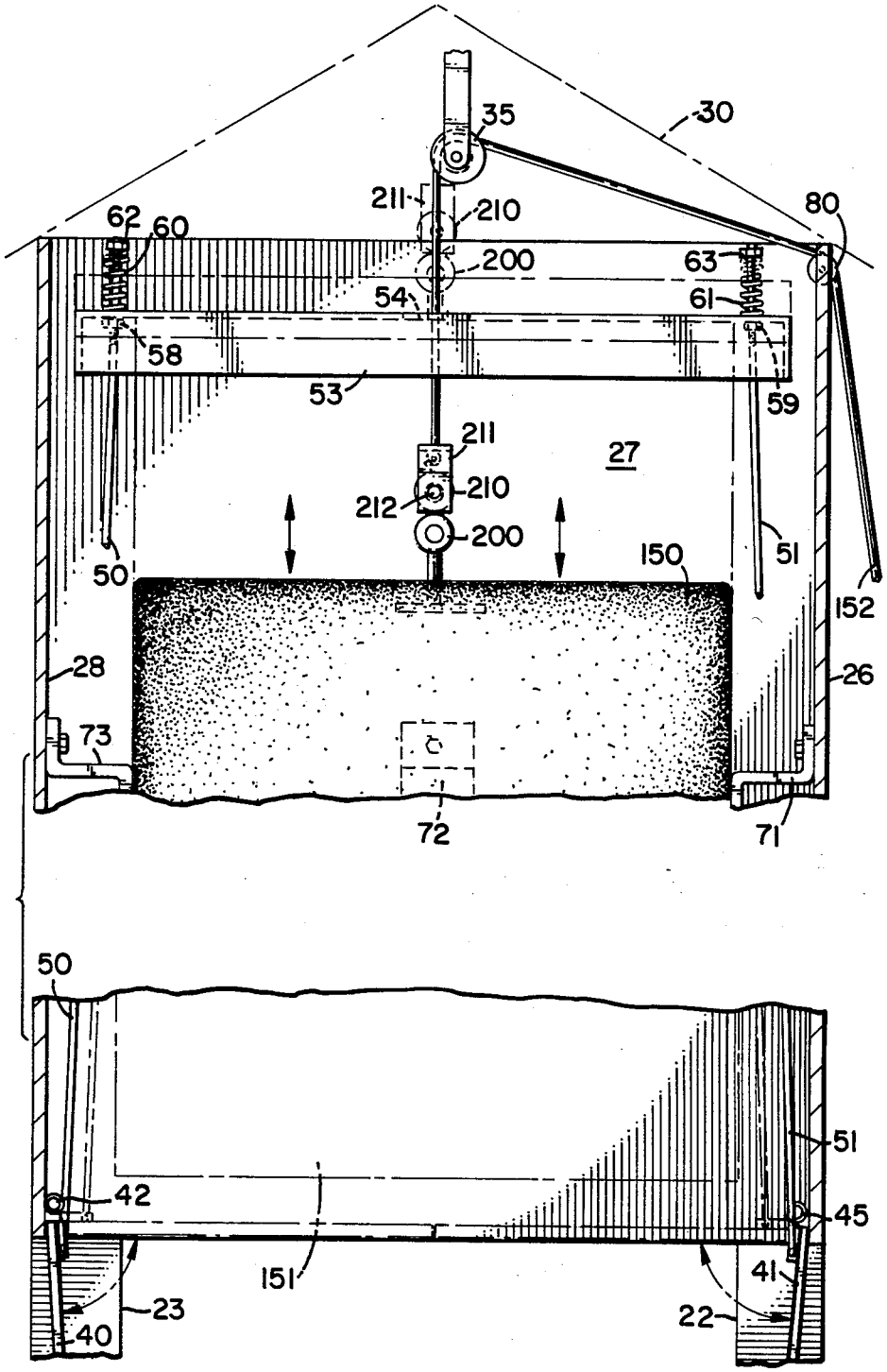
FIG. 5 is a cutaway side view of the top section of the chimney sweeping apparatus according to the present invention taken along the lines 5—5 of FIG. 4.

Referring to FIGS. 1, 4 and 5 the chimney sweeping apparatus of the present invention will now be explained. A cement block 150 and brush 151 are suspended inside frame 12 via a cable 152, which travels over and under pulley members 160, 161, 80 and 35, to permit movement of brush 151 up and down the chimney flue by rotation of winch 170, by which the cable 152 may be played in and out. Preferably, winch 170 is mounted on the side of the house 171 so that the same may be reached while the operator's feet are planted firmly on the ground. The winch may be mounted inside the building with the cable running through the roof, if desired.

Block or weight 150 is preferably constructed of cast concrete, so that during the casting process eyelet bolt 200 may be set therein. Likewise, on the opposite side thereof, a brush mounting member 205 (FIG. 1) may be cast in the concrete. Preferably, member 205 includes threads or other means so that brush 151 may be removed for cleaning or replacement. Welded to or otherwise formed with eyelet bolt 200 is a washer or eye member 210, via which eyelet 200 and block 150 may be removably attached to bracket member 211 via nut and bolt or cotter pin apparatus 212. Eyelet bolt 200 serves an additional function not readily appreciated from the drawing: a long rod may be passed through the opening in the eyelet so as to support block and brush 150 and 151 from the top of the flue with the block and brush extending down into the flue. This, of course, is quite helpful in installing or maintaining the apparatus. Bracket member 211 is fastened by any suitable means to the cable 152.

The operation of the trapped doors of the present invention will now be briefly explained. When block 150 and brush 151 are in their uppermost storage position, for example as may be seen with reference to FIG. 5 in the phantom line position, spring members 60 and 61 are compressed and rod members 50 and 51 pulled to their extreme upwardly extended position, thus closing trap doors 40 and 41, as shown in the solid lines of FIG. 4. Conversely, when block member 150 and brush 151 are lowered via cable 152 the upward force on rods 50 and 51 is released, and trap doors 40 and 41 open downwardly as shown in the half-down phantom line position of FIG. 4, and the fully-down solid line position as shown in FIG. 5. When passing through top section 16 of frame 12, members 70–73 act as guides for block and brush 150 and 151 to assure their proper positioning therewithin, and, more importantly, to align the brush and weight for entry into the flue when lowered out of the top section. Thus, as may readily be appreciated, when block and brush 151 are raised to their top most storage or out-of-use position, trap doors 40 and 41 are drawn closed so that the brush 151 and the inside of top section 16 remains shielded from chimney effluents, rain and wind etc. Moreover, trap doors 40 and 41 operate automatically in response to the position of block and brush 150 and 151 so that operation of the chimney sweeping apparatus of the present invention may be simply and easily accomplished from safely on the ground via winch 170. Furthermore, bottom section 14 of frame 12 provides ample ventilation for the escape of effluents from the chimney flue 10.

Of course, brush 151, or block 150, may be of any shape desired to accommodate the particular flue geometry on which the present invention is sought to be employed. Moreover, it should also be appreciated that block 150 may be of any geometry or configuration, as it is only necessary that enough weight be provided so as to push, via the force of gravity, brush 151 down through the flue during a chimney sweeping or cleaning operation. Moreover, guide members 70–73 may be shaped and mounted to accommodate any particular brush, block and flue configurations, as may be readily appreciated. Obviously, it is preferable that as little weight as possible be used so that structural support may be minimized. Relatedly, further gearing or pulley systems may be employed to provide a mechanical advantage when raising or lowering block and brush 150 and 151.

Aside from its obvious functions, the present invention provides several other advantageous functions not readily appreciable. The frame and covered top section provides a rain cap over the flue, and relatedly helps control downdrafts. Also, when the chimney is not in use for prolonged periods, the brush and weight may be lowered into the chimney and thereby prevent squirrels, birds and the like from nesting therein.

Although the present invention has been described herein in its preferred form, those skilled in the art will readily appreciate that various modifications may be made thereto without departing from the spirit and scope of the invention as set forth in the claims appended hereto.

What is claimed is:

1. Chimney cleaning apparatus, comprising:

a frame and means for mouunting said frame to the top of a chimney, said frame enclosed to provide a housing on the top part thereof and including openings on the bottom part thereof for venting chimney effluents;

pulley means mounted for free rotation near the top center of said housing;

chimney sweeping means suspended by a cable passing through an opening in said housing and running over said pulley means, said cable accessible from a remote location for moving said sweeping means up and down the chimney flue for cleaning thereof, said sweeping means stowable inside said housing when not in use; and bottom door means connected to said housing with hinges for selectively covering the bottom opening in said housing to substantially seal the interior of said housing from chimney effluent when said chimney sweeping means is stored in said housing, said hinges mounted between said door means and said housing so that when said door means is in the closed position said hinges are substantially sealed within said housing.

2. Chimney cleaning apparatus, comprising:

a frame and means for mounting said frame to the top of a chimney, said frame enclosed to provide a housing on the top part thereof and including openings on the bottom part thereof for venting chimney effluents;

pulley means mounted for free rotation near the top center of said housing;

chimney sweeping means suspended by a cable passing through an opening in said housing and running over said pulley means, said cable accessible from a remote location for moving said sweeping means up and down the chimney flue for cleaning thereof, said sweeping means stowable inside said housing when not in use; and first and second bottom doors for selectively covering the bottom opening in said housing to substantially seal the interior of said housing from chimney effluents, each of said doors hingedly mounted to said housing on opposite interior walls thereof so that said hinges are enclosed within said housing when said doors are closed; and means responsive to said sweeping means for drawing said doors closed when said sweeping means is pulled up into said housing and for releasing said doors from the closed position as said sweeping means is lowered from said housing.

3. Chimney cleaning apparatus according to claim 2 wherein said means responsive to said sweeping means comprises first and second linkages each connected at a borrom end to one of said doors and interactive with a cap member near the top end thereof, said cap member for engaging said sweeping means when it is raised up into said housing and causing said linkages to draw said doors closed.

4. Chimney cleaning apparatus according to claim 3 wherein said linkages each comprise:

an elongate rod hingedly connected at the bottom end to one of said doors;

said rod including a threaded extent on the top end thereof, said threaded extent extending through an aperture in said cap member;

first and second adjustable-position nuts disposed on the threaded extend of said rod above and below said cap member respectively;

spring coil means disposed around said rod above said cap member and below said first nut for providing a biasing force for holding a door shut.

5. Chimney cleaning apparatus according to claim 1 or 2 further including guide means mounted on the interior of said housing for guiding said sweeping means down into the chimney flue in proper axial alignment therewith.

6. Chimney cleaning apparatus according to claim 1, 2, 3 or 4 wherein said frame includes four legs and wherein said means for mounting said frame to said chimney comprises:

four right-angle brackets each for extending around one corner of a chimney flue;

each of said brackets having two legs, each leg including sleeve means secured thereto;

four bolts, each bolt extending through and between the sleeve means on the legs of said brackets which are disposed on the same side of the flue;

nuts threadedly secured to the ends of said bolts so as to draw said brackets into clamping engagement about the flue; and each of said brackets further including a slotted bracket member pivotably secured thereto for providing a mounting point for a leg of said frame.

7. Chimney cleaning apparatus according to claim 1, 2, 3 or 4 wherein said frame includes four legs and wherein said means for mounting said frame to said chimney comprises:

four curved brackets each for extending around an extent of a round chimney flue;

each of said brackets including a pair of longitudinally extending sleeve means secured on opposite halves thereof;

four bolts, each bolt extending through and between the sleeve means which are circumferentially adjacent on the flue;

nuts threadedly secured to the ends of said bolts so as to draw said brackets into clamping engagement about the flue; and each of said brackets further including a slotted bracket member pivotably secured thereto for providing a mounting point for a leg of said frame.

* * * * *